US008463152B2

(12) United States Patent
Tsujita

(10) Patent No.: US 8,463,152 B2
(45) Date of Patent: Jun. 11, 2013

(54) IMAGE FORMING APPARATUS, METHOD OF CONTROLLING THE SAME, AND NON-TRANSITORY COMPUTER-READABLE STORAGE MEDIUM

(75) Inventor: Kosuke Tsujita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 12/862,468

(22) Filed: Aug. 24, 2010

(65) Prior Publication Data

US 2011/0058840 A1 Mar. 10, 2011

(30) Foreign Application Priority Data

Sep. 9, 2009 (JP) ..... 2009-208595

(51) Int. Cl.
*G03G 15/00* (2006.01)

(52) U.S. Cl.
USPC ..... 399/82

(58) Field of Classification Search
USPC ..... 399/82, 401
See application file for complete search history.

(56) References Cited

U.S. PATENT DOCUMENTS

| | | | | |
|---|---|---|---|---|
| 2004/0130747 | A1 | 7/2004 | Ohishi et al. | |
| 2005/0084278 | A1* | 4/2005 | Kimura et al. | 399/82 |
| 2005/0207807 | A1* | 9/2005 | Tombs | 399/341 |
| 2007/0278730 | A1 | 12/2007 | Mori et al. | |

FOREIGN PATENT DOCUMENTS

| | | | |
|---|---|---|---|
| JP | 01-249479 | A | 10/1989 |
| JP | 2-198461 | A | 8/1990 |
| JP | 2004-286885 | A | 10/2004 |
| JP | 2007-322819 | A | 12/2007 |

OTHER PUBLICATIONS

Russian Patent Office, Office Action dated Nov. 28, 2011, in connection with Russian Patent Application No. 2010137462, 4 pages.

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

When executing an image forming process for same sheets divisionally a plurality of number of times, a subsequent image forming process needs to be prevented from becoming impossible depending on the process result of a preceding image forming process. To accomplish this, when executing a second image forming process for a sheet having an image formed by a first image forming process is designated, an image forming apparatus of this invention restricts execution of post-processing for the sheet that has undergone the first image forming process even when executing the post-processing for the sheet is designated.

9 Claims, 11 Drawing Sheets

IMAGE FORMING APPARATUS, METHOD OF CONTROLLING THE SAME, AND NON-TRANSITORY COMPUTER-READABLE STORAGE MEDIUM

BACKGROUND OF THE INVENTION

1. Field of the Invention

The present invention relates to an image forming apparatus, a method of controlling the same, and a non-transitory computer-readable storage medium.

2. Description of the Related Art

Image forming apparatuses such as a multi function peripheral having a double-sided printing function or a function of printing using a transparent toner so as to give a gloss to sheets have been known recently. When implementing these functions, some of the image forming apparatuses execute a series of processes of processing sheets fed from a feeding unit and discharging them divisionally a plurality of number of times.

For example, Japanese Patent Laid-Open No. 01-249479 proposes the following method for an image forming apparatus without an automatic double-sided printing function. More specifically, the apparatus prints one surface of a sheet fed from a feeding unit, and then discharges it to the discharge tray. When the user sets the sheet in the feeding unit again, the apparatus prints the other surface. Even the image forming apparatus having no automatic double-sided printing function can thus implement double-sided printing.

However, when performing image formation divisionally two times, if post-processing such as stapling is executed for sheets that have undergone the first print process, the sheets cannot be fed for the second print process. This disturbs the print process.

SUMMARY OF THE INVENTION

The present invention has been made in consideration of the above-described problem. The present invention provides a mechanism for, when executing an image forming process for same sheets divisionally a plurality of number of times, preventing a subsequent image forming process from becoming impossible depending on the process result of a preceding image forming process.

One aspect of the present invention provides an image forming apparatus for forming an image on a sheet fed from a feeding unit, comprising: an execution unit that executes a first image forming process of forming an image on the sheet and outputting the sheet, and a second image forming process of, after the first image forming process, feeding the sheet that has undergone the first image forming process from a feeding unit, and forming an image on the sheet; a designation unit that designates, before executing the first image forming process, whether to execute the second image forming process for the sheet having the image formed by the first image forming process; and a control unit that, when the designation unit designates to execute the second image forming process, controls to restrict execution of post-processing for the sheet having the image formed by the first image forming process even when executing the post-processing for the sheet is designated.

Another aspect of the present invention provides a method of controlling an image forming apparatus for forming an image on a sheet fed from a feeding unit, comprising: causing an execution unit to execute a first image forming process of forming an image on the sheet and outputting the sheet, and a second image forming process of, after the first image forming process, feeding the sheet that has undergone the first image forming process from a feeding unit, and forming an image on the sheet; causing a designation unit to designate, before executing the first image forming process, whether to execute the second image forming process for the sheet having the image formed by the first image forming process; and causing a control unit to, when executing the second image forming process is designated in the designating step, control to restrict execution of post-processing for the sheet having the image formed by the first image forming process even when executing the post-processing for the sheet is designated.

Still another aspect of the present invention provides a non-transitory computer-readable storage medium storing a program for automating a two-pass printing method on an image forming apparatus, the program comprising: instructions to perform a first image-forming process of forming an image on a sheet; instructions to output the sheet that has undergone the first image-forming process in a condition for re-feeding of the sheet so that the sheet can be collected by a user; instructions to re-feed the sheet from a sheet-feeding unit after re-location of the sheet by the user to the sheet-feeding unit; and instructions to perform a second image-forming process on the re-fed sheet.

According to the present invention, it is possible to, when executing an image forming process for same sheets divisionally a plurality of number of times, prevent a subsequent image forming process from becoming impossible depending on the process result of a preceding image forming process.

Further features of the present invention will become apparent from the following description of exemplary embodiments (with reference to the attached drawings).

DESCRIPTION OF THE EMBODIMENTS

An embodiment of the present invention will be described below.

<Arrangement of POD System 10>

Figure 1:
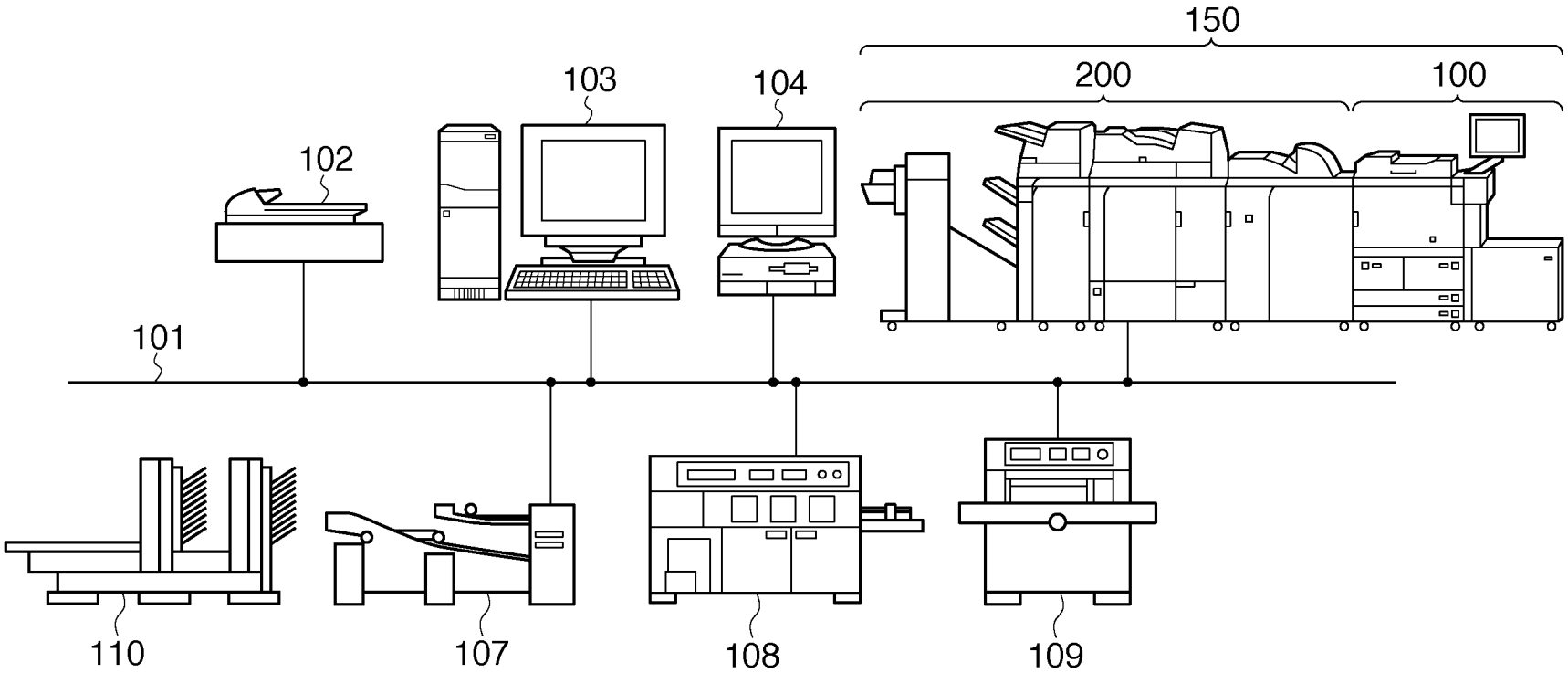
FIG. 1 is a view showing an example of the arrangement of a POD system 10 according to an embodiment of the present invention.

An example of the arrangement of a POD (Print On Demand) system 10 will be described first with reference to FIG. 1. The POD system 10 includes a printing system 150, scanner 102, server computer (PC) 103, and client computer (PC) 104, which are connected via a network 101. The printing system 150 includes an image forming apparatus 100 and sheet processing apparatuses 200.

In this embodiment, an MFP (Multi Function Peripheral) having a plurality of functions such as a copy function and a printer function will be exemplified as the image forming apparatus 100. Note that the image forming apparatus 100 may be an SFP (Single Function Peripheral) of single function type having only a copy function or a printer function. Note that any number of sheet processing apparatuses 200 can be connected to the image forming apparatus 100.

The server PC 103 manages data transmission/reception between the printing system 150 and the apparatuses connected to the network 101. The client PC 104 transmits image data to the MFP 100 of the printing system 150 or the server PC 103 via the network 101 to cause the printing system 150 to form (print) the image of the image data on a printing medium (paper or sheet). The MFP 100 can execute not only a print process for sheets but also post-processing such as bookbinding processing for the sheets using the sheet processing apparatuses 200. Note that the present invention is not limited to this, and the server PC 103, the client PC 104, or one of post-processing apparatuses 107 to 110 to be described later may execute the post-processing for the sheets.

The POD system 10 further includes post-processing apparatuses such as the sheet folding apparatus 107, case binding apparatus 108, sheet cutting apparatus 109, and saddle stitching apparatus 110. The post-processing apparatuses other than the saddle stitching apparatus 110 are connected to the network 101 so as to be able to transmit/receive data to/from the other apparatuses via the network 101. The post-processing apparatuses 107 to 110 execute post-processing such as bookbinding processing for sheets printed by the MFP 100. The sheet folding apparatus 107 performs folding processing of sheets printed by the MFP 100. The case binding apparatus 108 performs case binding processing of sheets printed by the MFP 100. The sheet cutting apparatus 109 performs cutting processing of sheets printed by the MFP 100 for each sheet bundle including a plurality of sheets. The saddle stitching apparatus 110 performs saddle stitching processing of sheets printed by the MFP 100.

To use one of the post-processing apparatuses 107 to 110, the user extracts, from the printing system 150, sheets printed by the MFP 100 and discharged, and sets them in the apparatus to be used, and executes processing. Note that even when sheets printed by a printing apparatus other than the MFP 100 are set, the post-processing apparatuses 107 to 110 can execute post-processing for the sheets.

<Arrangement of Printing System 150>

Figure 2:
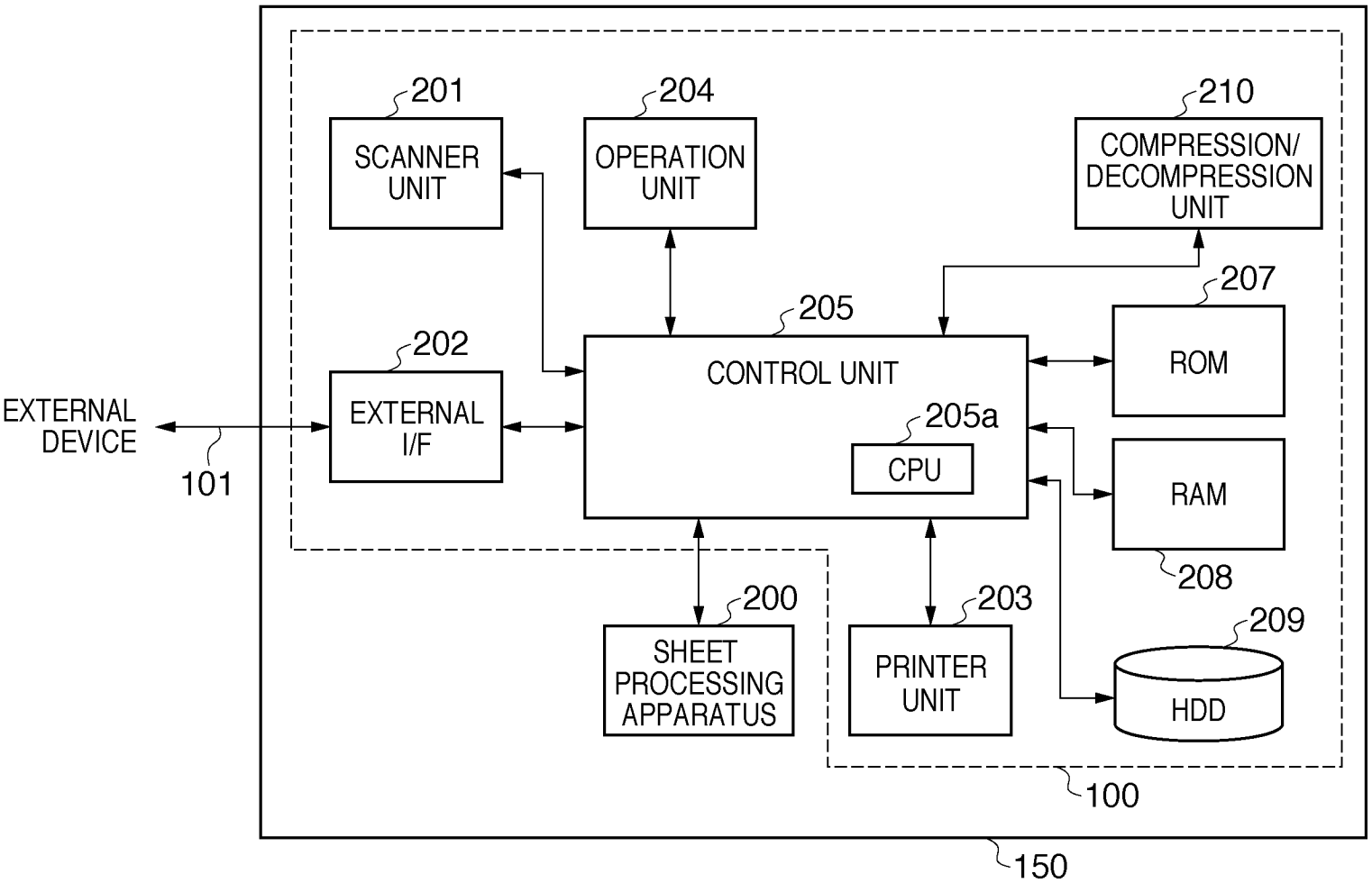
FIG. 2 is a block diagram showing an example of the arrangement of a printing system 150 according to the embodiment of the present invention.

An example of the arrangement of the printing system 150 will be described next with reference to FIG. 2. In addition to the MFP 100, the printing system 150 includes the sheet processing apparatuses 200 serving as post-processing apparatuses. The sheet processing apparatuses 200 are communicably connected to the MFP 100. In the printing system 150, the MFP 100 can instruct the sheet processing apparatuses 200 to execute post-processing for printed sheets. Based on the instruction received from the MFP 100, the sheet processing apparatuses 200 execute post-processing for the sheets printed by the MFP 100. The printing system 150 may include only the MFP 100 if the sheet processing apparatuses 200 are unnecessary because, for example, the post-processing is to be executed not by the sheet processing apparatuses 200 but by only the other post-processing apparatuses 107 to 110. Note that post-processing for sheets will sometimes be referred to as sheet processing or finishing processing hereinafter.

A scanner unit 201 reads an image on a document, converts it into image data, and transfers it to another unit. An external I/F 202 transmits/receives data to/from another apparatus via the network 101. A printer unit 203 prints an image on a sheet based on input image data. An operation unit 204 includes a hard key input unit (key input unit) 402 and a touch panel unit, as will be described later, and receives user instructions via these units. The operation unit 204 also displays various screens on the touch panel unit. A control unit 205 includes a CPU 205*a*, and causes it to control the processing, operation, and the like of each unit included in the printing system 150. More specifically, the control unit 205 controls the processing, operation, and the like of not only each unit of the MFP 100 but also the sheet processing apparatuses 200 connected to the MFP 100.

A ROM 207 stores various kinds of computer programs to be executed by the CPU 205*a*. For example, the ROM 207 stores programs which cause the control unit 205 to execute the processes of steps of flowcharts to be described later and a display control program which displays, on the operation unit 204, various kinds of setting screens to be described later. In addition, the ROM 207 stores font information and a program which causes the control unit 205 to interpret PDL (Page Description Language) code data received from the server PC 103, client PC 104, or the like and execute processing of rasterizing the data into raster image data.

A RAM 208 stores image data transmitted from the scanner unit 201 or the external I/F 202, and various kinds of programs and set information loaded from the ROM 207. The RAM 208 also stores information about the sheet processing apparatuses 200 (for example, the number of sheet processing apparatuses 200, information about the functions of each apparatus, and the connection order of the apparatuses). Note that data write in the RAM 208 and data read from the RAM 208 are implemented under the control of the CPU 205*a*.

An HDD 209 includes a hard disk drive, and a driving unit for reading/writing data from/in the hard disk drive. The HDD 209 is a mass storage device which stores image data input from the scanner unit 201 or the external I/F 202, or image data compressed by a compression/decompression unit 210. The compression/decompression unit 210 can execute compression/decompression processing of image data or the like stored in the RAM 208 or the HDD 209 based on various kinds of compression methods such as JBIG and JPEG.

The control unit 205 can output image data stored in the HDD 209 to the printer unit 203 to print an image on a sheet based on a user instruction input via the operation unit 204 or the network 101. The control unit 205 can also transmit image data stored in the HDD 209 to an external device such as the server PC 103 via the external I/F 202 based on the instruction.

(Hardware Configuration of MFP 100)

An example of the hardware configuration of the MFP 100 of the printing system 150 will be described next with reference to FIG. 3. An ADF (Automatic Document Feeder) 301 separates each document sheet from a bundle of document sheets set on the stacking plane of a document tray, and conveys the document sheet onto a glass document table. The scanner unit 201 scans to read the document sheet conveyed onto the glass document table, and causes the CCD to convert the read image into image data. A rotating polygon mirror 303 receives a laser beam modulated using the image data. The laser beam is reflected by a reflecting mirror so as to irradiate a photosensitive drum 304 as scanning light. An electrostatic latent image is thus formed on the photosensitive drum 304. The electrostatic latent image is developed using a developing material (toner) so that a toner image is formed on the photosensitive drum 304. The toner image is then transferred to a sheet on a transfer drum 305.

The MFP 100 sequentially executes the above-described series of image forming processes (print processes) for each of yellow (Y), magenta (M), cyan (C), and black (K) toners, thereby forming a full color image on the sheet. Also, to give a gloss to a printed product generated by the print process using the color toners of Y, M, C, and K, the MFP 100 can perform, for the printed product, a print process (to be referred to as "clear coat printing" hereinafter) using a special transparent (CL) toner (clear toner).

The sheet with the transferred image is separated from the transfer drum 305 by a separation gripper 306, and conveyed to a fixing unit 308 by a prefixing conveyor 307. The fixing unit 308 including rollers and a belt incorporates a heat source such as a halogen heater so as to fuse and fix the toner image on the sheet by heat and pressure. A discharge flapper 309 swings about the swing axis to define the sheet conveyance direction. When the discharge flapper 309 pivots clockwise in FIG. 3, the sheet is discharged out of the apparatus by discharge rollers 310. The control unit 205 controls the above-described series of processes, thereby implementing single-sided printing of forming an image on one surface of a sheet.

Figure 3:
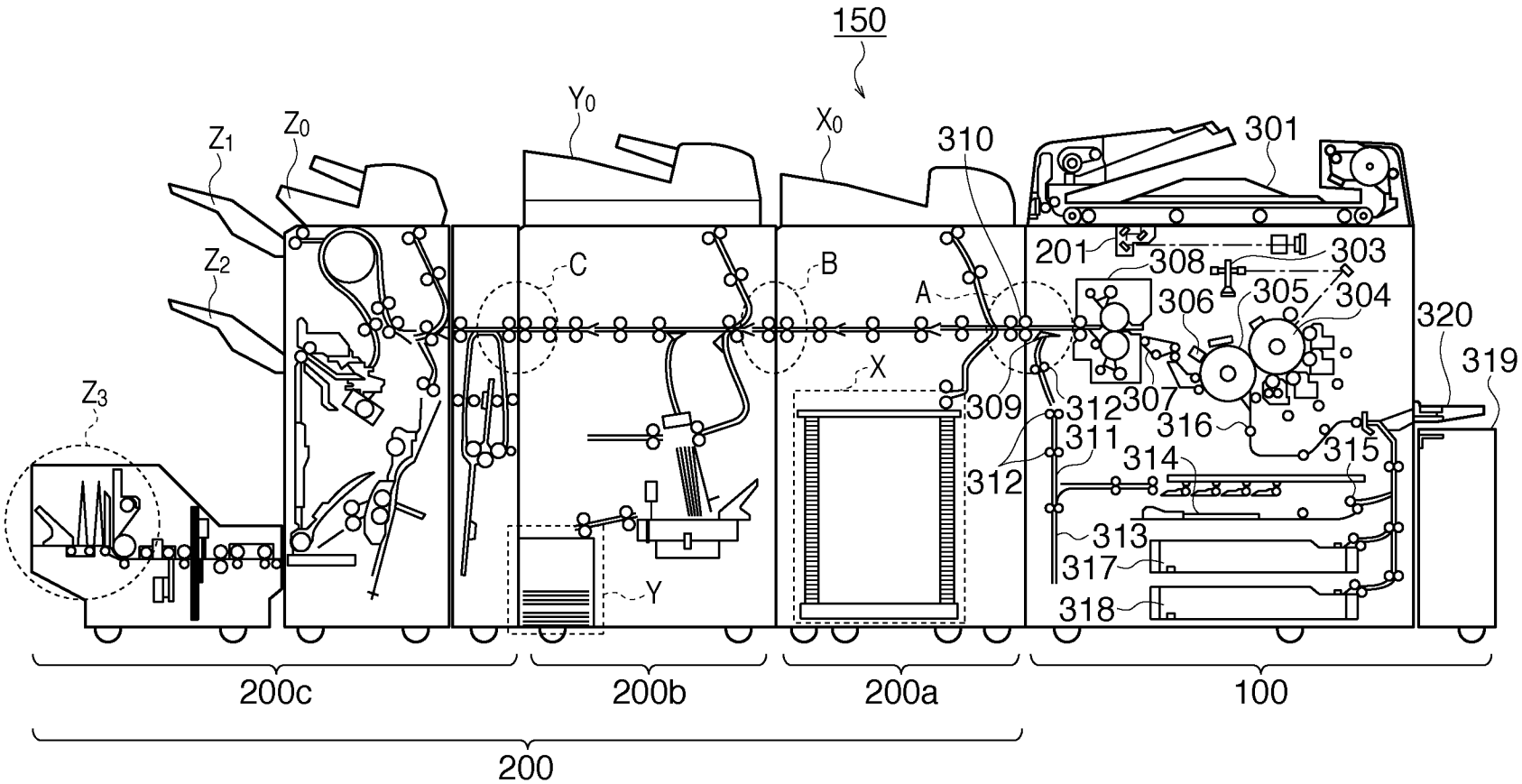
FIG. 3 is a sectional view showing a cross section of the printing system 150 according to the embodiment of the present invention.

On the other hand, in a double-sided printing mode in which images are formed on both surfaces of a sheet, the control unit 205 causes the discharge flapper 309 to pivot counterclockwise in FIG. 3. The sheet changes its route downward, and is conveyed to a double-sided conveyance unit. The double-sided conveyance unit includes a reversing flapper 311, reversing rollers 312, reversing guide 313, and double-side tray 314. The reversing flapper 311 pivots about the pivotal axis to define the sheet conveyance direction.

To implement double-sided printing, the control unit 205 controls to cause the printer unit 203 to execute the print process of one surface (first surface) of a sheet, and convey the sheet to the reversing guide 313 via the reversing rollers 312. Then, the control unit 205 temporarily stops the rotation of the reversing rollers 312 while keeping the trailing edge of the sheet sandwiched by the reversing rollers 312. After that, the control unit 205 makes the reversing flapper 311 pivot clockwise in FIG. 3, and rotates the reversing rollers 312 in the reverse direction. The control unit 205 thus switches the sheet back and conveys the sheet whose leading and trailing edges have replaced their positions to the double-side tray 314. The sheet is temporarily stacked on the double-side tray 314, and then conveyed to a registration roller 316 again by re-feed rollers 315. At this time, the surface of the sheet on the opposite side of that in the first surface print process faces the photosensitive drum 304. After that, the control unit 205 executes the same process as the first surface print process for the other surface (second surface) of the sheet, thereby implementing double-sided printing.

The MFP 100 also includes a feeding unit which stores sheets to be printed. The MFP 100 may have a plurality of feeding units. For example, in FIG. 3, the MFP 100 includes feed cassettes 317 and 318, feed deck 319, and manual feed tray 320 serving as feeding units. The feed cassettes 317 and 318 and the feed deck 319 can store sheets in different numbers. For example, each of the feed cassettes 317 and 318 can store 500 sheets, and the feed deck 319 can store 5,000 sheets. Note that various kinds of sheets in different sizes and materials can be set in the feed cassettes 317 and 318 and the feed deck 319. On the other hand, various kinds of sheets including special sheets such as an OHP sheet can be set on the manual feed tray 320. Each feeding unit has feed rollers which rotate to continuously feed sheets one by one.

(Arrangement of Operation Unit 204 of MFP 100)

Figure 4:
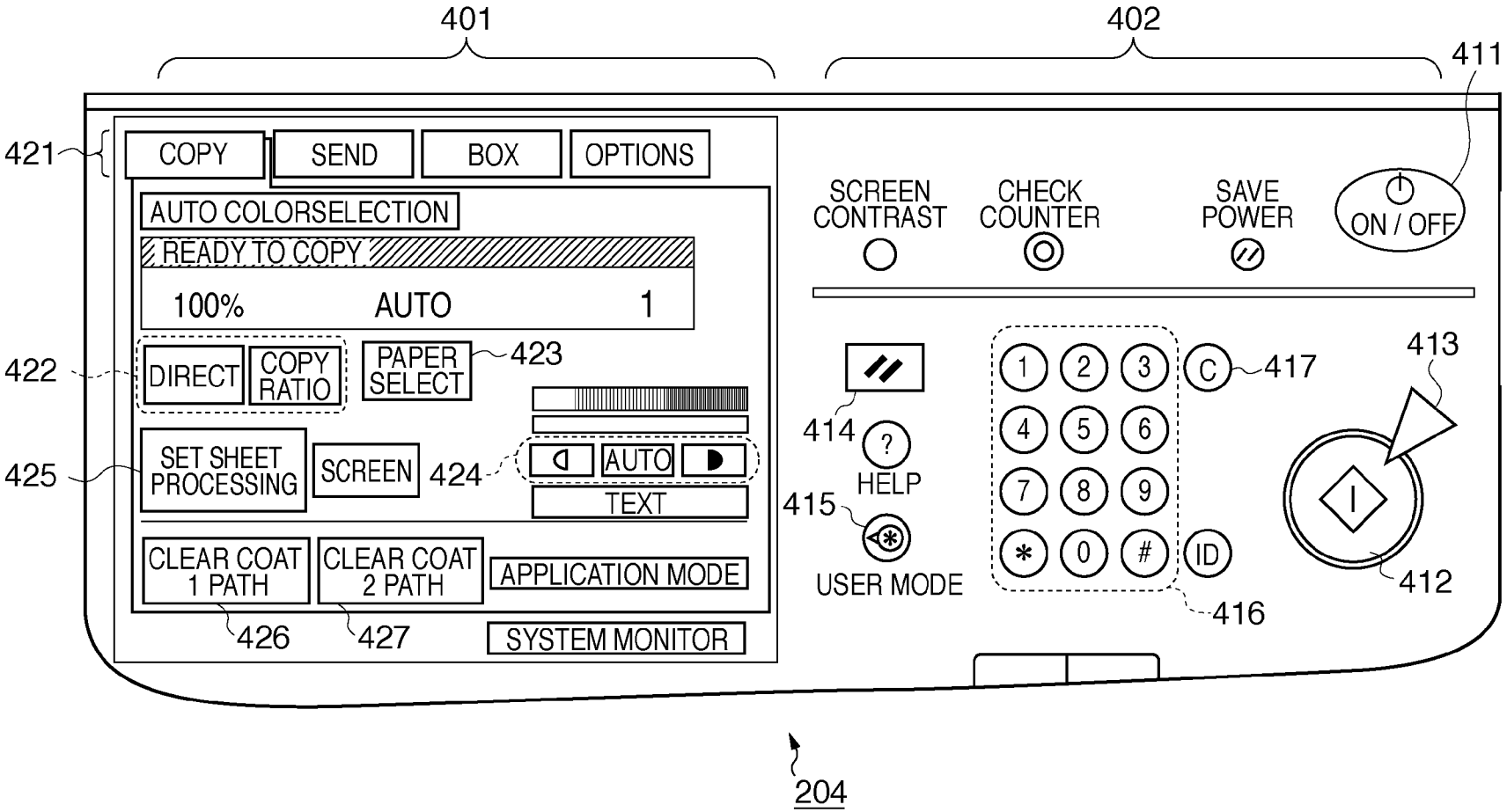
FIG. 4 is a view showing an example of the outer appearance of an operation unit 204 of an MFP 100 according to the embodiment of the present invention.

The arrangement of the operation unit 204 of the MFP 100 will be described next with reference to FIG. 4. The operation unit 204 includes a touch panel unit 401 and the key input unit 402. Based on user instructions input via the touch panel unit 401 and the key input unit 402, the control unit 205 controls the printing system 150 to implement various processes.

The touch panel unit 401 includes a liquid crystal display unit and a transparent electrode bonded to its upper surface. The touch panel unit 401 has a function of displaying various kinds of screens, and an instruction input function of causing the user to input instructions. FIG. 4 illustrates an example of the screen displayed on the touch panel unit 401 in which buttons 421 to be used to set operation modes such as "copy", "send", "box", and "options" are displayed as soft-keys. FIG. 4 also shows buttons 422 to 424 to be used to do settings of the print ratio, paper selection, print density, and the like, a button 425 to be used to do settings concerning post-processing, and buttons 426 and 427 to be used to do settings of clear coat printing, which are displayed as soft-keys.

The key input unit 402 includes a power key 411, start key 412, stop key 413, guide key 414, user mode key 415, and ten-key pad 416. The start key 412 is used to cause the MFP 100 to start executing a copy job or a send job. The ten-key pad 416 is used to input the numerical value of, for example, the number of copies.

(Hardware Configuration of Sheet Processing Apparatuses 200)

An example of the hardware configuration of the sheet processing apparatuses 200 in the printing system 150 will be described next with reference to FIG. 3. An arbitrary number of apparatuses of arbitrary types can be connected as the sheet processing apparatuses 200 if they can convey sheets via a conveyance path. FIG. 3 shows an example in which a large-volume stacker 200*a*, glue binding apparatus 200*b*, and saddle stitching apparatus 200*c* are connected in this order from upstream close to the MFP 100 to downstream with respect to the sheet conveyance direction. The user can selectively use these apparatuses via the MFP 100 in the printing system 150. The user can also cause the sheet discharge unit of a selected sheet processing apparatus to discharge sheets that have undergone predetermined post-processing.

The control unit 205 of the MFP 100 controls display on the touch panel unit 401 so as to receive a post-processing execution request via the screen displayed on the touch panel unit 401. For example, when the user presses the instruction button 425 on the screen shown in FIG. 4, the control unit 205 displays a setting screen shown in FIG. 5. The control unit 205 displays, as soft-keys on the setting screen, buttons 511 to 519 corresponding to post-processes executable by the sheet processing apparatuses 200 connected to the MFP 100. The user can designate post-processing to be executed by the sheet processing apparatuses 200*a* to 200*c* by pressing one of the buttons 511 to 519.

After selecting one post-processing, the user can set a job to execute the post-processing by pressing an OK button 521. Note that the user can also cancel the job using a cancel button 520. Upon receiving a print job execution request from the user via the operation unit 204, the control unit 205 causes the printer unit 203 to execute the print process based on the print job. The control unit 205 also conveys the sheet that has undergone the print process to a predetermined sheet processing apparatus via the sheet conveyance path, and executes the post-processing based on the set job.

Figure 5:
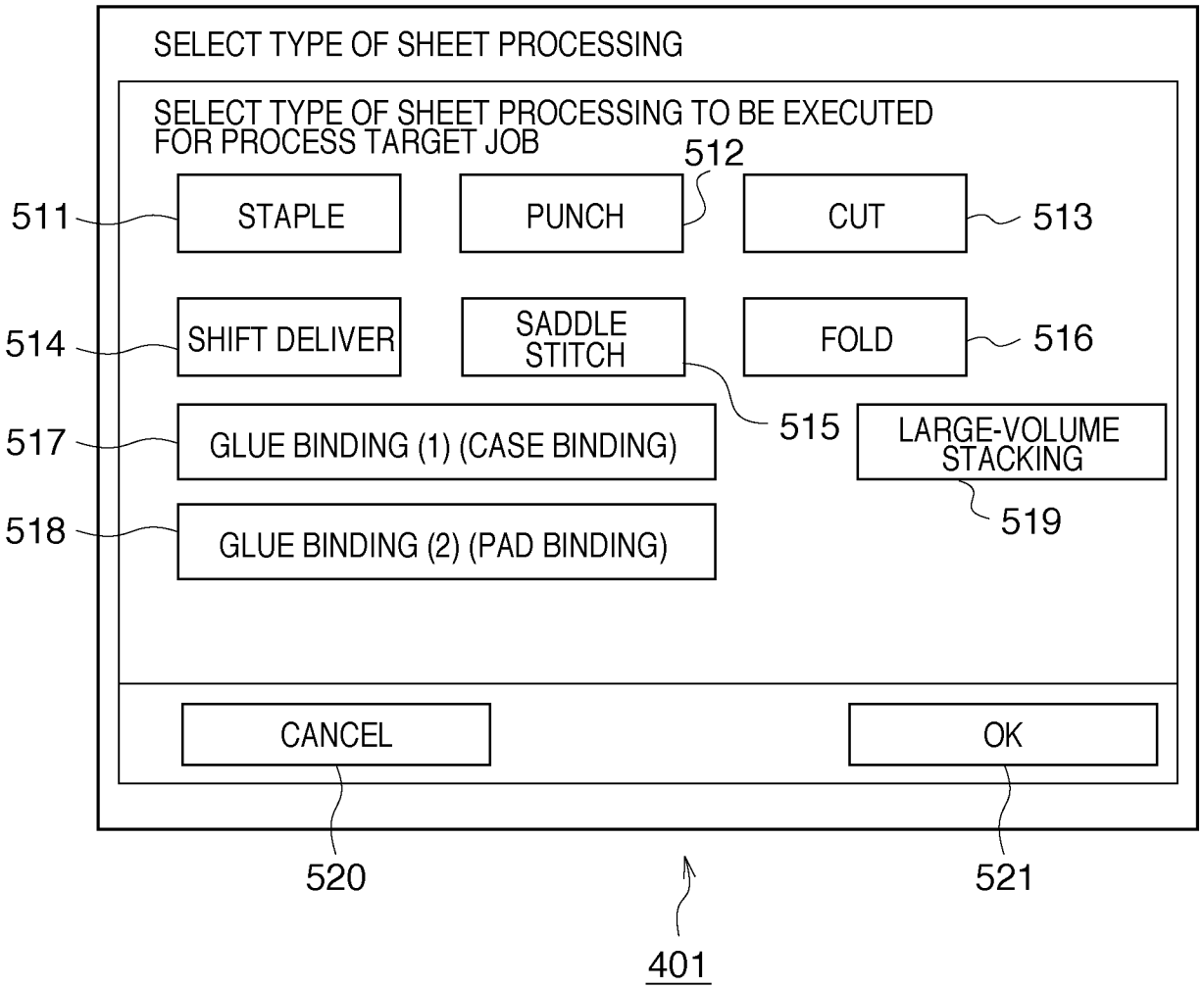
FIG. 5 is a view showing an example of a setting screen displayed on a touch panel unit 401 of the MFP 100 according to the embodiment of the present invention.

For example, when the user presses the button 519 in the setting screen of FIG. 5, a stacker job for large-volume stacking processing is executed as post-processing after print job execution in the MFP 100. In this embodiment, the large-volume stacker 200*a* executes the stacker job. When the printing system 150 is to execute the stacker job, the control unit 205 conveys sheets printed by the MFP 100 into the large-volume stacker 200*a* via a point A in FIG. 3. The control unit 205 also executes processing of stacking the sheets at a discharge destination X inside the large-volume stacker 200*a* without conveying them from the large-volume stacker 200*a* to another apparatus (for example, the glue binding apparatus 200*b* or saddle stitching apparatus 200*c* downstream). The user can extract the stacked sheets directly from the discharge destination X. This makes it possible to extract printed products from the large-volume stacker 200*a* that exists upstream without conveying the sheets up to the most downstream discharge unit (one of discharge units Z1, Z2, and Z3) with respect to the sheet conveyance direction.

Note that in this embodiment, the large-volume stacker 200*a* has an escape tray Xo serving as a discharge destination outside the apparatus. If sheets which are not employable as final products are conveyed from the MFP 100, the escape tray Xo is used to discharge these sheets. For example, the printing system 150 can discharge, to the escape tray Xo, sheets that have already been fed (sheets that exist inside the apparatus) in case of occurrence of a print interrupt factor such as paper jam or multiple sheets fed in an overlapped (overlap feeding) state. This allows to discharge such sheets out of the apparatus without conveying them to the downstream apparatus.

For example, when the user presses one of the buttons 517 and 518 in the setting screen of FIG. 5, an glue binding job to execute one of case binding processing and pad binding processing is executed as post-processing after print job execution in the MFP 100. In this embodiment, the glue binding apparatus 200*b* executes the glue binding job. When the printing system 150 is to execute the glue binding job, the control unit 205 conveys sheets printed by the MFP 100 into the glue binding apparatus 200*b* via the points A and B in FIG. 3. After the glue binding apparatus 200*b* has executed the glue binding processing of the sheets, the control unit 205 holds the sheets at a discharge destination Y inside the glue binding apparatus 200*b*. Note that when executing case binding processing, a cover sheet which has undergone the print process in advance can be set on a tray Yo and used for the processing.

For example, when the user presses one of the buttons 511 to 516 in the setting screen of FIG. 5, post-processing after print job execution in the MFP 100 is executed. For example, a saddle stitching job to execute one of staple processing, punch processing, sheet cutting processing, shift deliver processing, saddle stitching processing, and folding processing is executed. In this embodiment, the saddle stitching apparatus 200*c* executes the saddle stitching job. When the printing system 150 is to execute the saddle stitching job, the control unit 205 conveys sheets printed by the MFP 100 to the saddle stitching apparatus 200*c* via the points A, B, and C. After the saddle stitching apparatus 200*c* has executed the saddle stitching processing of the sheets, the control unit 205 discharges the sheets to one of the discharge units Z1, Z2, and Z3. Note that the discharge units Z1, Z2, and Z3 are used to, for example, discriminate the discharge destinations of the post-processes in the saddle stitching apparatus 200*c*. In FIG. 3, Z3 indicates the discharge destination (booklet holding unit) of a printed product that has undergone saddle stitching processing. Z2 indicates the discharge destination (stack tray) of a printed product that has undergone one of staple processing, punch processing, and folding processing. Z1 indicates the discharge destination (sample tray) of a printed product to be directly discharged without executing post-processing.

Note that in this embodiment, the saddle stitching apparatus 200*c* has a tray Zo which supplies sheets that have undergone the print process in advance. The sheets supplied from the tray Zo are merged with the sheets conveyed from the MFP 100. This enables to execute the saddle stitching processing by setting, for example, cover sheets on the tray Zo and adding the cover sheets to the plurality of sheets printed by the MFP 100.

<Print Mode of MFP 100>

The above-described MFP 100 sometimes executes a print process for the same sheets fed from the feed cassettes 317 to 320 divisionally a plurality of number of times. Examples are the above-described clear coat printing and double-sided printing. For example, when executing a print process divisionally in two steps, a first process (first image forming process) of executing normal printing on sheets is executed first. Then, the discharged sheets are fed from one of the feeding units, and a second process (second image forming process) of printing the sheets again is executed.

When executing the above-described clear coat printing, the MFP 100 can select an image forming mode (print mode) from a 1-step mode in which the print process is executed in one step and a 2-step mode in which the print process is executed in two steps. In the 1-step mode, the MFP 100 executes the print process for sheets conveyed from a feeding unit sequentially using C, M, Y, K, and CL toners. In the 2-step mode, the MFP 100 executes a first process of printing sheets conveyed from a feeding unit using C, M, Y, and K toners, and discharges the printed sheets. When the user sets the discharged sheets again on the feeding unit, the MFP 100 executes a second process of printing the sheets using a CL toner. In the second process, the MFP 100 prints an image using the CL toner on the same surfaces as the surfaces with images printed using the C, M, Y, and K toners in the first process. Note that although the first and second processes are defined as described above, the present invention is not limited to this, and any other processes may be assigned to these processes. For example, the first process may be a process of printing one surface (obverse surface) of a paper sheet using the C, M, Y, and K toners, and the second process may be a process of printing the other surface (reverse surface) of the paper sheet using the C, M, Y, and K toners. Alternatively, the first process may be a process of printing one surface (obverse surface) of a paper sheet using the C, M, Y, and K toners, and the second process may be a gloss process of smoothing the obverse surface of the paper sheet by heat and pressure via a glosser (not shown). The glosser may be provided as a post-processing apparatus separated from the MFP 100 or provided in the MFP 100.

In the 1-step mode of clear coat printing, since all the five color toner images are transferred in one print process, the time required for the print process is short. However, the total toner amount fixable at once is restricted in accordance with the toner amount fixable by the fixing unit at once. For this reason, in the 1-step mode in which not only the four C, M, Y, and K toners but also the CL toner is fixed in one process, the fixable transparent toner amount is inevitably restricted. On the other hand, according to the 2-step mode, only the transparent toner is fixed in the second process. This allows to increase the fixable transparent toner amount as compared to the 1-step mode.

In the MFP 100 according to this embodiment, the user inputs a clear coat printing execution instruction via the operation unit 204. For example, when the user presses one of the buttons 426 and 427 in FIG. 4, a print job to execute clear coat printing in a print mode selected from the 1-step mode and the 2-step mode is set in the MFP 100. In FIG. 4, the button 426 (clear coat 1 path) corresponds to the 1-step mode, and the button 427 (clear coat 2 path) corresponds to the 2-step mode. The print mode is selected by causing the user to press one of the buttons. In addition, when the user presses the start key 412 of the operation unit 204, an execution instruction of the print job is given to the MFP 100. Note that the print job setting and execution instruction may be input from the server PC 103 or the client PC 104 connected via the network.

If post-processing is designated in the MFP 100 for a print job that executes clear coat printing in the 2-step mode, the post-processing may disturb the second process. More specifically, assume that stapling, folding processing, or bookbinding processing is designated as post-processing of the first process. Even when sheets that have undergone the first process are set in the feeding unit, the sheets cannot be fed directly, resulting in a disturbance of the second process. The MFP 100 according to this embodiment controls to, for example, prohibit execution of post-processing set for the first process when executing a print process such as clear coat printing or double-sided printing in the 2-step mode, thereby preventing execution of the second process from being disturbed. The print process of the MFP 100 according to this embodiment will be described below in more detail.

<Procedure of Print Process in Printing System 150>

The processing procedure of clear coat printing will be described next with reference to FIGS. 6 to 9 as an example of the print process of the MFP 100 according to this embodiment. Note that the processes of steps shown in FIGS. 6 to 9 are implemented by causing the CPU 205*a* of the control unit 205 to read out and execute the programs stored in, for example, the ROM 207.

Figure 6:
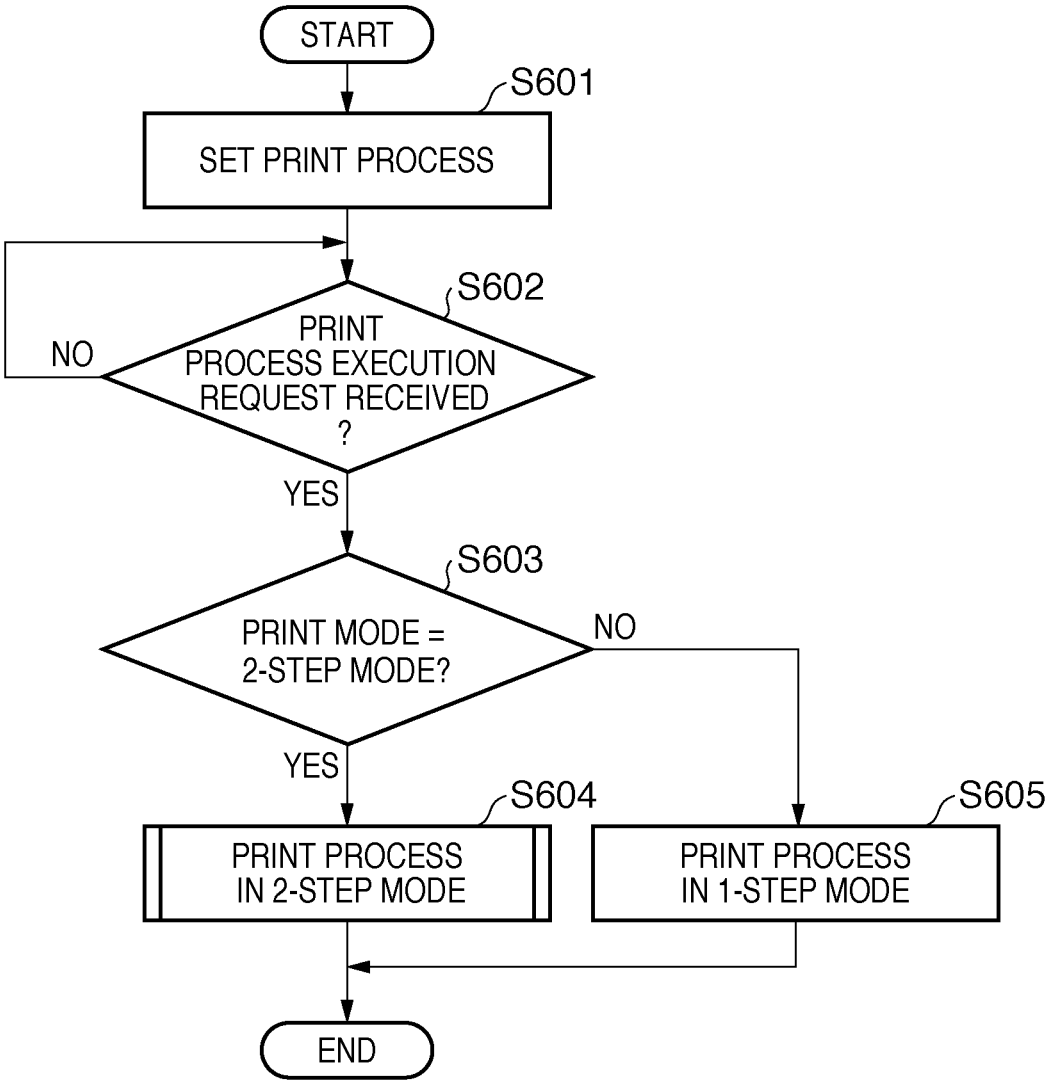
FIG. 6 is a flowchart illustrating a print job setting and execution procedure of the MFP 100 according to the embodiment of the present invention.

A print job setting and execution procedure of the MFP 100 will be explained first with reference to FIG. 6. In step S601, the control unit 205 displays a predetermined setting screen on the touch panel unit 401, as shown in FIG. 4, to receive user inputs associated with print job settings. The print job settings include a designation of post-processing described with reference to FIG. 5 as well as selection of the 1-step mode or the 2-step mode of clear coat printing described with reference to FIG. 4. That is, the control unit 205 enables designation of post-processing based on an instruction input by the user before the start of processing in the selected print mode. Based on the instruction, the control unit 205 generates print setting data, and stores it in the RAM 208. Then, the control unit 205 advances the process to step S602.

In step S602, the control unit 205 determines whether a print process execution request has been received. The execution request is transmitted from the operation unit 204 to the control unit 205 when, for example, the user presses the start key 412 of the operation unit 204. The control unit 205 repeats the determination process until it receives the execution request. Upon receiving the execution request, the control unit 205 reads out the print setting data from the RAM 208 and starts the clear coat print process in the set print mode. Then, the process advances to step S603.

In step S603, the control unit 205 determines by referring to the print setting data read out from the RAM 208 whether the print mode is the 2-step mode. Upon determining that the print mode is not the 2-step mode but the 1-step mode, the process advances to step S605. In step S605, the control unit 205 controls the printer unit 203 so as to execute the print process using the CL toner in addition to the C, M, Y, and K toners in one process as usual, and ends the processing. Additionally, in the 1-step mode, if post-processing such as staple processing, folding processing, or bookbinding processing is designated in the print process setting of step S601, the post-processing is executed for the printed sheets. On the other hand, upon determining in step S603 that the print mode is the 2-step mode, the process advances to step S604. In step S604, the print process in the 2-step mode is executed in accordance with one of the procedures in FIGS. 7 to 9 to be described later, and the processing ends.

The processing procedure of clear coat printing in the 2-step mode of step S604 will be described next with reference to FIG. 7. In step S701, the control unit 205 determines whether the print setting data stored in the RAM 208 includes setting data of post-processing. The control unit 205 thus determines whether post-processing is designated for the first process of clear coat printing. If no post-processing is designated for the first process, the process advances to step S703. On the other hand, if post-processing is designated, the process advances to step S702. In step S702, the control unit 205 cancels the setting to prohibit post-processing execution for the sheets printed by the first process. After that, the process advances to step S703.

In step S703, the control unit 205 controls the printer unit 203 so as to execute the print process using the C, M, Y, and K toners as the above-described first process. As a result, the sheets are discharged to a predetermined discharge unit such as the discharge unit Z1 or Z2. Then, the process advances to step S704.

In step S704, the control unit 205 determines whether preparation for execution of the second process of clear coat printing is completed. The control unit 205 repeats the determination process in step S704 until the preparation is completed. At the preparation, the user extracts the discharged sheets from the discharge unit, and sets them in a predetermined feeding unit again. The predetermined feeding unit may be either a feeding unit designated by the user in step S601 or a feeding unit preset as the feeding unit of the second process. The control unit 205 determines that the sheets are placed in the feeding unit when, for example, a sheet detection sensor provided in the feeding unit detects the sheets. When the user presses the start key 412, the control unit 205 determines that the preparation of the second process is completed, and advances the process to step S705.

In step S705, the control unit 205 controls the printer unit 203 so as to execute the print process using the CL toner as the above-described second process. After that, the sheets are discharged to a predetermined discharge unit, and the processing ends.

Figure 10:
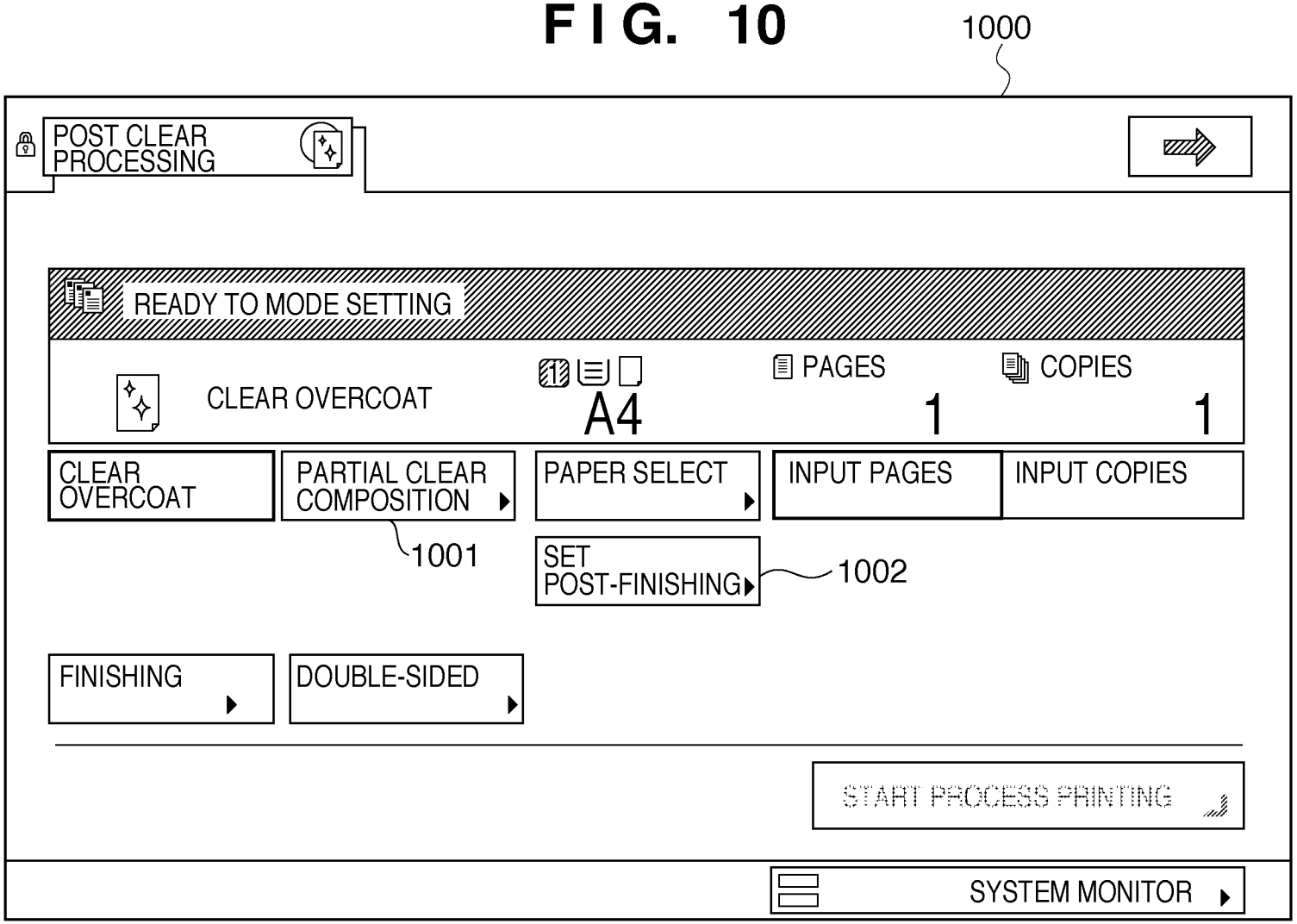
FIG. 10 is a view showing an example of a setting screen concerning the second process of clear coat printing in the 2-step mode according to the embodiment of the present invention.
Figure 11:
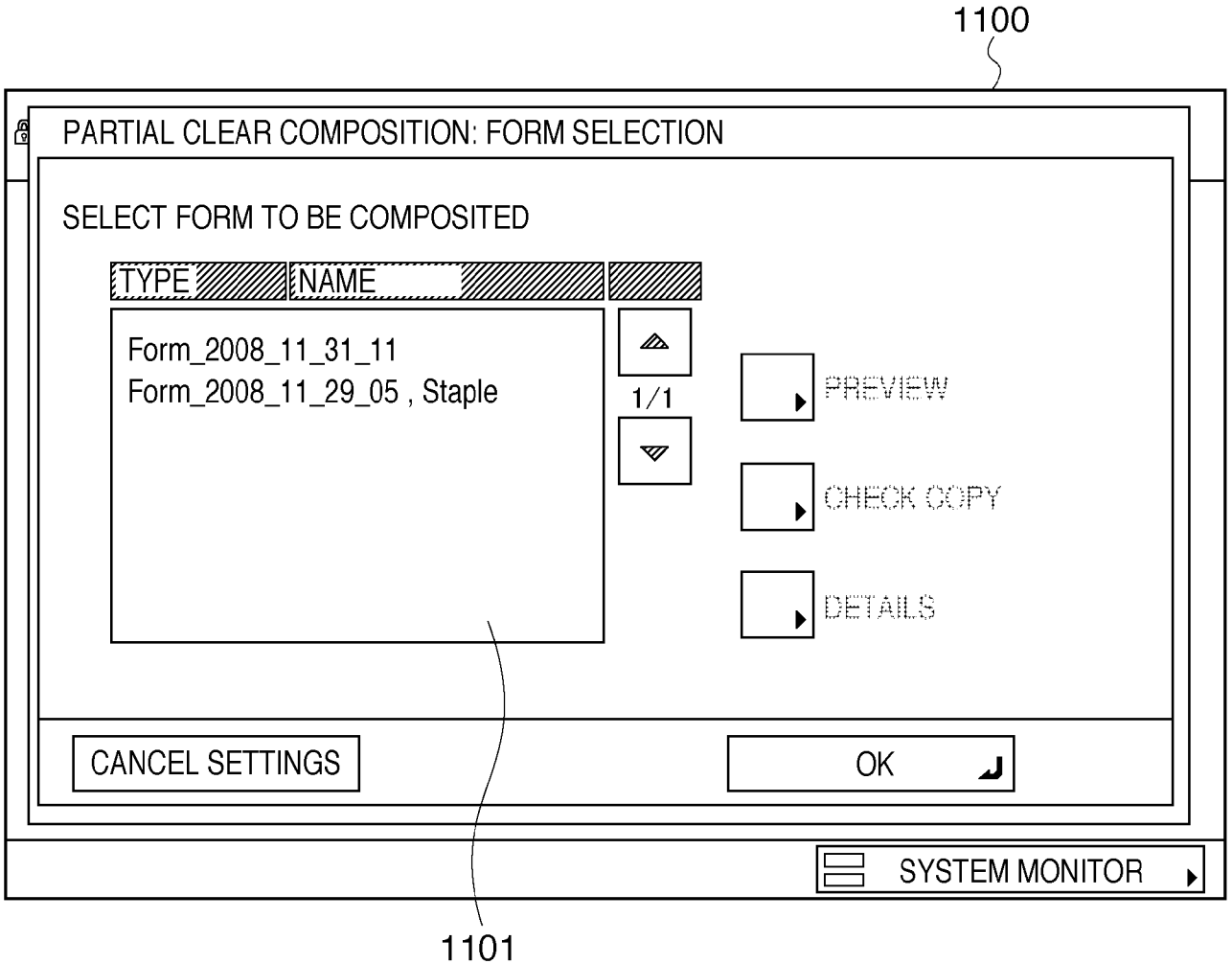
FIG. 11 is a view showing an example of a setting screen to be used to designate a registered form to be used in the second process of clear coat printing in the 2-step mode according to the embodiment of the present invention.

In step S704 described above, if the user has operated the touch panel unit 401 at any timing between setting the sheets in the feeding unit and pressing the start key 412, the control unit 205 controls to display a setting screen 1000 shown in FIG. 10 on the touch panel unit 401. This allows the user to set an image forming process or post-processing to be executed in the second process. For example, it is possible to set the density of an image forming process to be executed in the second process or post-processing to be executed for sheets with images formed by the second process. In addition, the user can cause the MFP 100 to execute, in the second process, a partial clear composition process of performing a print process by a transparent toner using a form registered in the MFP 100 in advance by pressing a button 1001 of the setting screen 1000. In this case, when the user presses the button 1001, the control unit 205 displays a setting screen 1100 shown in FIG. 11 on the touch panel unit 401. The user can select a registered form to be used in the second process by selecting a registered form displayed in a field 1101 using the setting screen 1100. The control unit 205 executes the second process or post-processing in accordance with the contents set in the setting screen 1000. Additionally, the control unit 205 may control to prohibit sheet size change in the setting screen 1000 shown in FIG. 10. Since the sheets are the same as those on which images are formed by the first process, the control makes it possible to prevent a failure of paper feed for the second process or appropriate image formation even if the user erroneously changes the sheet size.

In the above-described processing, the control unit 205 may prohibit executing only post-processing that disturbs execution of the second process, instead of indiscriminately prohibiting post-processing execution. In this case, when it is determined in step S701 that post-processing is designated, the control unit 205 further determines whether the designated post-processing disturbs execution of the second process. Only when determining that the designated post-processing disturbs execution of the second process, the control unit 205 prohibits execution of the post-processing. This allows to improve the user convenience. Examples of processing that disturbs executing the second process are the above-described staple processing, folding processing, and bookbinding processing. Upon determining that the designated post-processing is such processing, the control unit 205 prohibits execution of the post-processing, as described above. On the other hand, upon determining that the designated post-processing is, for example, large-volume stacking processing using the large-volume stacker 200*a*, which does not disturb executing the second process, the control unit 205 need not prohibit execution of the post-processing.

To prohibit the above-described post-processing, the control unit 205 may prohibit pressing each button corresponding to the post-processing to be prohibited in the setting screen shown in FIG. 5, which is displayed in the print process setting of step S601. In this case, the control unit 205 may display, in the setting screen, for example, grayout background for each button corresponding to the post-processing to be prohibited so that the user can recognize that designation of the post-processing is impossible.

Figure 7:
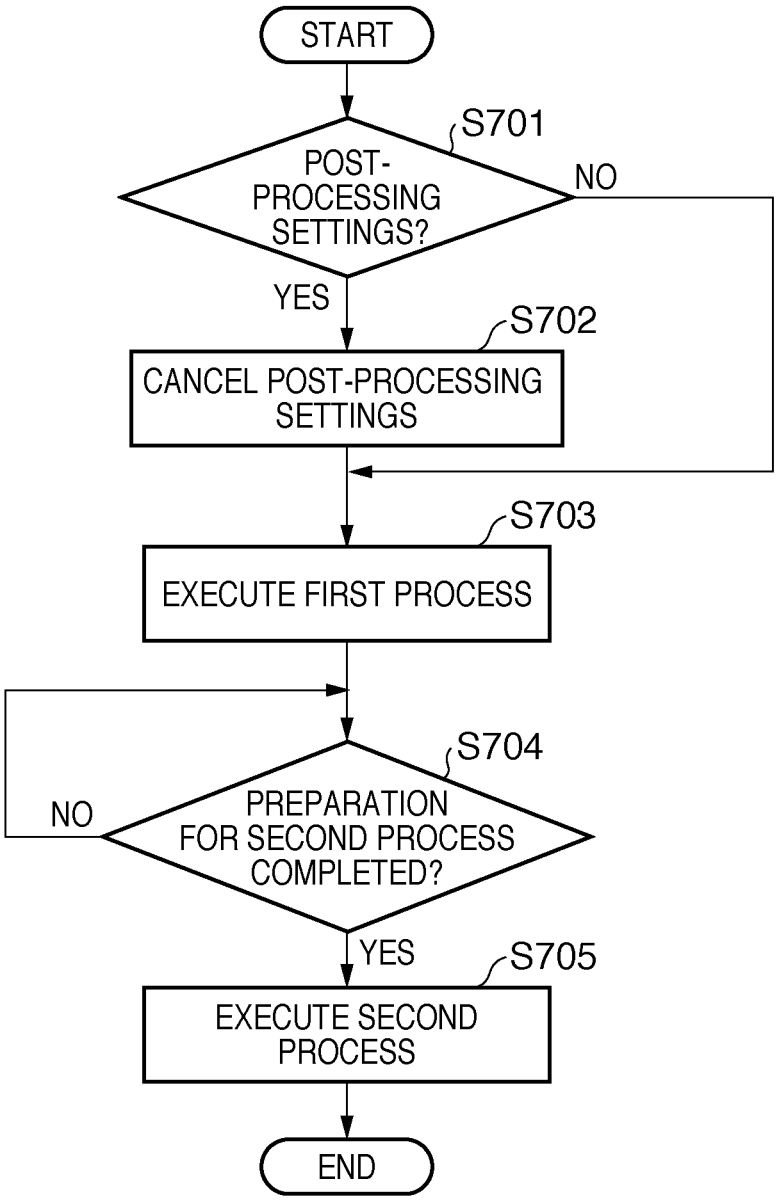
FIG. 7 is a flowchart illustrating the processing procedure of clear coat printing in the 2-step mode of the MFP 100 according to the embodiment of the present invention.

In the above-described processing shown in FIG. 7, to prevent a disturbance of execution of the second process, the MFP 100 prohibits execution of post-processing designated for the first process of clear coat printing. However, after the second process, even when the MFP 100 executes post-processing of sheets, it never disturbs the second process. A first modification of this embodiment will be described with reference to FIG. 8 in which post-processing designated for the first process is executed for sheets after the second process has been executed.

Figure 8:
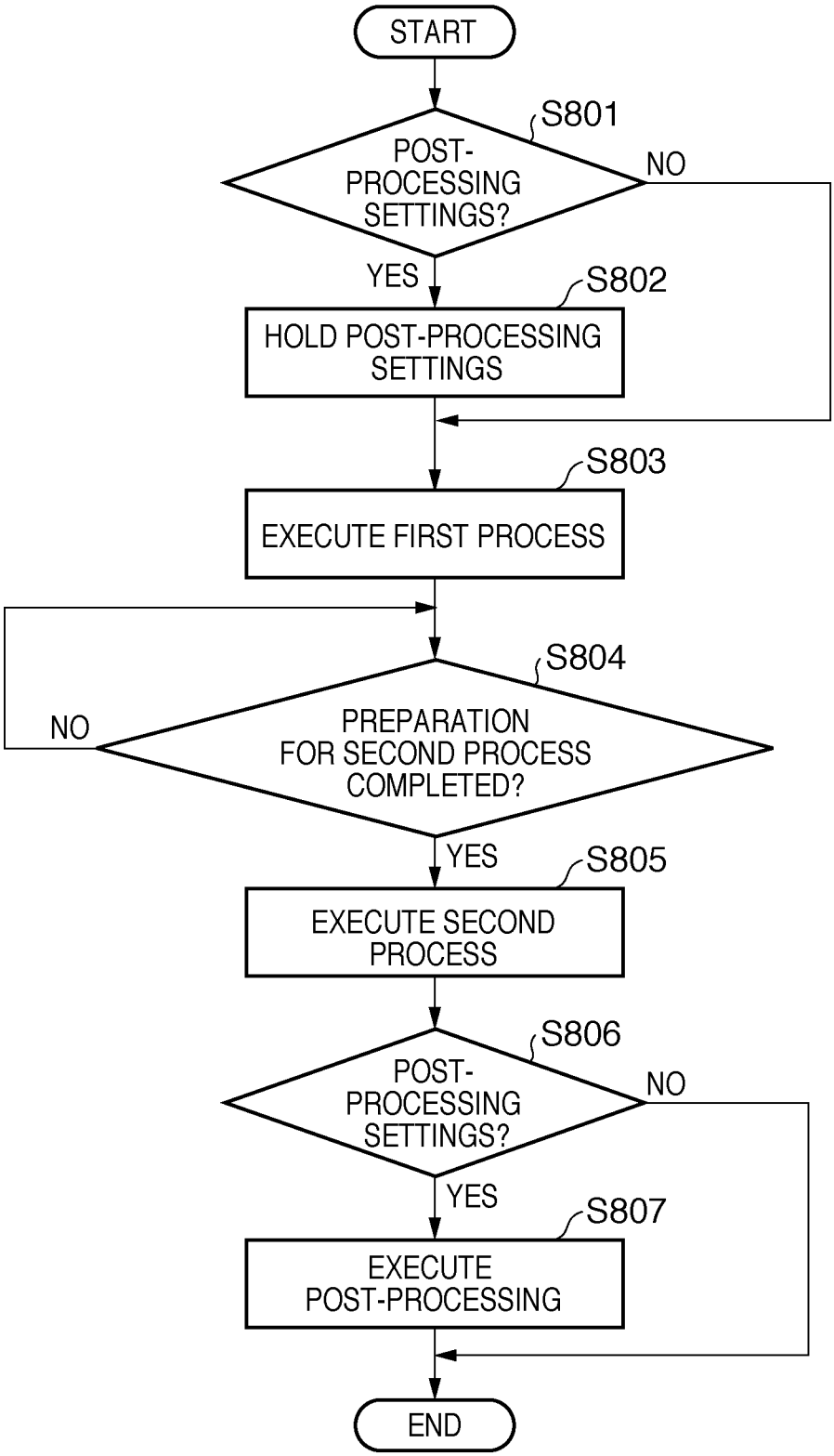
FIG. 8 is a flowchart (first modification) illustrating the processing procedure of clear coat printing in the 2-step mode of the MFP 100 according to the embodiment of the present invention.

For the processes of steps in FIG. 8, a description of parts common to FIG. 7 will be omitted, and different parts will mainly be described below. Step S801 is the same as step S701. If post-processing is designated for the first process, the process advances to step S802. In step S802, the control unit 205 prohibits post-processing execution after execution of the first process. However, the control unit 205 continuously holds the setting data without canceling the settings concerning post-processing, unlike step S702. Then, the process advances to step S803.

Steps S803 to S805 are the same as steps S703 to S705, and a description thereof will not be repeated. Note that in the setting screen displayed by the control unit 205 in step S804, a button corresponding to the post-processing set to be executed is displayed as already set based on the held setting data. For example, if setting data representing that staple processing is to be executed is held, the control unit 205 displays a setting screen in which stapling is already selected. After executing the second process in step S805, the control unit 205 advances the process to step S806. In step S806, the control unit 205 determines by referring to the RAM 208 whether held setting data of post-processing exists. If the setting data does not exist, the processing ends. If the setting data exists, the process advances to step S807 to execute the designated post-processing. Then, the processing ends.

Note that when the MFP 100 executes clear coat printing in the 2-step mode, even if print settings associated with post-processing have not been done in step S601, post-processing for the second process can be designated later at any timing before the start of the second process. A second modification of the embodiment will be described here. More specifically, a case will be described with reference to FIG. 9 in which when performing clear coat printing in the 2-step mode, no post-processing is designated in step S601, but post-processing to be executed after execution of the second process is designated at a timing from completion of the first process to the start of the second process.

For the processes of steps in FIG. 9, a description of parts common to FIG. 7 will be omitted, and different parts will mainly be described below. Note that since it is assumed that no print settings concerning post-processing have been done in step S601, FIG. 9 does not include steps corresponding to S701 and S702.

Step S901 is the same as step S703. After executing the first process, the process advances to step S902. In step S902, the control unit 205 allows to designate post-processing as a preparation for execution of the second process. The control unit 205 controls to, for example, display the setting screen 1000 shown in FIG. 10 on the touch panel unit 401. In the setting screen 1000, a button 1002 is used to activate a screen to designate post-processing. When the user presses the button 1002, the control unit 205 may control to display, for example, the setting screen shown in FIG. 5. This allows the user to designate post-processing for the second process even at a timing from completion of the first process to the start of the second process. Note that if post-processing is designated here, the control unit 205 stores the setting data of the post-processing in the RAM 208.

In step S902, in addition to the above-described control, when the user sets the sheets in the feeding unit, and presses the start key 412, the control unit 205 determines that preparation for execution of the second process is completed, as in step S704, and the process advances to step S903.

In step S903, the control unit 205 executes the second process as in step S705, and advances the process to step S904. In step S904, the control unit 205 determines by referring to the RAM 208 whether the settings concerning post-processing exist. If the setting data does not exist in the RAM 208, the control unit 205 ends the processing. If the setting data exists, the process advances to step S905 to execute the designated post-processing. Then, the processing ends.

Figure 9:
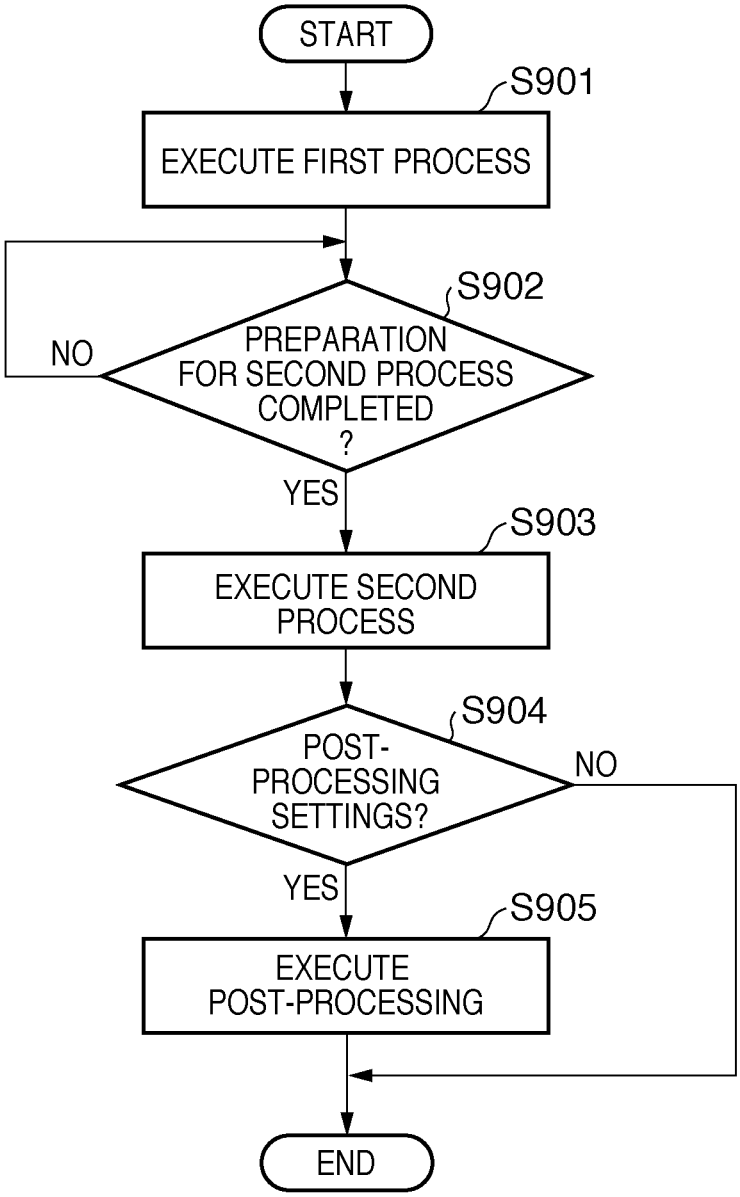
FIG. 9 is a flowchart (second modification) illustrating the processing procedure of clear coat printing in the 2-step mode of the MFP 100 according to the embodiment of the present invention.

Note that the above-described processing in FIG. 9 assumes that print settings concerning post-processing have not been done in advance in step S601. Even when print settings concerning post-processing have been done, post-processing may be settable at a timing from completion of the first process to the start of the second process. In this case, the control unit 205 executes processes corresponding to steps S701 and S702 or steps S801 and S802 before step S901. The control unit 205 may allow, in step S902, to newly designate post-processing or change the post-processing set in step S601.

As described above, the image forming apparatus according to this embodiment executes a print job including a print process in two steps, that is, a first process of forming images on sheets, and a second process of feeding the sheets that have undergone the first process from a feeding unit again and forming images on them. In this case, if the print job sets post-processing to be executed for the sheets after execution of the first process, the image forming apparatus controls to restrict execution of the post-processing. This makes it possible to prevent the sheets set in the feeding unit from becoming unfeedable before the start of the second process and thus prevent a disturbance of execution of the second process. Note that when restricting execution of post-processing, the control unit 205 may, for example, prohibit executing the post-processing or prohibit the execution after notifying the user that the post-processing is to be prohibited. Upon receiving the notification, the user may select canceling the job, executing the first process without executing the post-processing, or executing the post-processing. When one of the options is selected, the control unit 205 executes processing in accordance with the user selection.

The image forming apparatus according to this embodiment may control not only to inhibit executing post-processing set for the first process but also to execute the post-processing after execution of the second process. This prevents a disturbance of execution of the second process and also quickly execute the designated post-processing for the sheets. The image forming apparatus according to this embodiment may be able to set and change post-processing to be executed for the sheets after execution of the second process at a timing not only before the start of the first process but also from completion of the first process to the start of the second process. This improves the user convenience.

Note that in this embodiment, the first process has been described as a process of printing using four colored C, M, Y, and K toners. In addition, the second process has been described as a process of printing, using a CL toner, a printed surface with an image formed by the four C, M, Y, and K toners. That is, in this embodiment, an example in which clear coat printing is executed in two processes has been described. However, the present invention is not limited to this, and is applicable to any image forming apparatus that uses a print job including a plurality of processes. For example, the present invention is applicable to an image forming apparatus for performing double-sided printing as a plurality of print processes, as described above. More specifically, the first process may be a print process for one surface of a paper sheet, and the second process may be a process for the other surface of the paper sheet. Alternatively, the first process may be a print process for one surface of a paper sheet, and the second process may be a gloss for the paper sheet.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-208595, filed Sep. 9, 2009, which is hereby incorporated by reference herein in its entirety.

What is claimed is:

1. An image forming apparatus for forming an image on a sheet fed from a feeding unit, the apparatus comprising:

an execution unit that executes an image forming process for forming an image on a surface of the sheet fed from the feeding unit and outputting the sheet, and executes a glossing process for, after the image forming process, feeding the sheet on which the image is formed by the image forming process from the feeding unit, and glossing the surface of the fed sheet; and a control unit that, when it is designated to execute the glossing process, controls to restrict, before execution of the glossing process for the sheet, execution of stapling processing for the sheet on which the image is formed by the image forming process even when it is designated to execute the stapling processing as post-processing for the sheet.

2. The apparatus according to claim 1, wherein said control unit further controls to execute the restricted stapling processing for the sheet after execution of the glossing process.

3. The apparatus according to claim 1, further comprising a receiving unit that, when it is designated to execute the glossing process, receives a setting for the stapling processing to be executed for the sheet glossed by the glossing process from a user at a timing from completion of the image forming process to a start of the glossing process.

4. The apparatus according to claim 1, wherein the image forming process is a process of forming an image on the surface of the sheet using a colored developing material, and the glossing process is a process of glossing, using a transparent developing material, the surface of the sheet on which the image is formed by the image forming process.

5. The apparatus according to claim 1, further comprising a designation unit that designates, before execution of the image forming process, whether to execute the glossing process.

6. An image forming apparatus for forming an image on a sheet feed from a feeding unit, the apparatus comprising:

an execution unit that executes an image forming process for forming an image on a surface of the sheet fed from the feeding unit and outputting the sheet, and executes a glossing process for, after the image forming process, feeding the sheet on which the image is formed by the image forming process from the feeding unit, and glossing the surface of the fed sheet; and a control unit that, when it is designated to execute the glossing process, controls to restrict, before execution of the glossing process for the sheet, execution of bookbinding processing for the sheet on which the image is formed by the image forming process even when it is designated to execute the bookbinding processing as post-processing for the sheet.

7. A method of controlling an image forming apparatus for forming an image on a sheet fed from a feeding unit, the method comprising:

executing an image forming process for forming an image on a surface of the sheet fed from the feeding unit and outputting the sheet, and a glossing process for, after the image forming process, feeding the sheet on which the image is formed by the image forming process from the feeding unit, and glossing the surface of the fed sheet; and controlling, when it is designated to execute the glossing process, to restrict, before execution of the glossing process for the sheet, execution of stapling processing for the sheet on which the image is formed by the image forming process even when it is designated to execute the stapling processing as post-processing for the sheet.

8. A non-transitory computer-readable storage medium storing a computer program that causes a computer to execute a method of controlling an image forming apparatus of claim 7.

9. An image forming apparatus for forming an image on a sheet fed from a feeding unit, the apparatus comprising:

an execution unit that executes an image forming process for forming an image on a surface of the sheet fed from the feeding unit and outputting the sheet, and executes a glossing process for, after the image forming process, feeding the sheet on which the image is formed by the image forming process from the feeding unit, and glossing the surface of the fed sheet; and a control unit that controls, when it is designated to execute the glossing process and it is designated to execute stapling process as post-processing for the sheet, to execute the stapling processing for the sheet on which the image is formed by the image forming process, wherein the control unit further controls, when it is designated to execute the glossing process and it is designated to execute the stapling process as the post-processing, to execute, not before execution of the glossing process but after execution of the glossing process, the stapling process for the sheet on which the image is formed by the image forming process.

* * * * *